US005979782A

United States Patent [19]

Elwart

[11] Patent Number: 5,979,782

[45] Date of Patent: Nov. 9, 1999

[54] FIREPLACE HEAT TRANSFER SYSTEM WITH INTERNALLY DRIVEN FLUID FLOW MECHANISM

[76] Inventor: Ron Elwart, 503 Girard #2, Royal Oak, Mich. 48073

[21] Appl. No.: 09/099,751

[22] Filed: Jun. 18, 1998

[51] Int. Cl.[6] ..... F24D 3/00

[52] U.S. Cl. ..... 237/8 C; 237/8 R; 237/16

[58] Field of Search ..... 237/53, 8 C, 8 R, 237/16; 126/21

[56] References Cited

U.S. PATENT DOCUMENTS

| | | |
|---|---|---|
| 4,008,703 | 2/1977 | Allgood . |
| 4,025,043 | 5/1977 | Cleer, Jr. . |
| 4,046,320 | 9/1977 | Johnson et al. . |
| 4,098,257 | 7/1978 | Stanko . |
| 4,100,913 | 7/1978 | Armstrong . |
| 4,142,507 | 3/1979 | Stanko . |
| 4,143,816 | 3/1979 | Skadeland . |
| 4,143,817 | 3/1979 | Oliver . |
| 4,153,199 | 5/1979 | Ell Mer . |
| 4,163,442 | 8/1979 | Welty . |
| 4,178,908 | 12/1979 | Trexler, Sr. . |
| 4,180,053 | 12/1979 | Patel . |
| 4,191,163 | 3/1980 | Ballard . |
| 4,203,417 | 5/1980 | Boyd . |
| 4,228,784 | 10/1980 | Malafouris . |
| 4,258,880 | 3/1981 | Williamson . |
| 4,330,083 | 5/1982 | Di Fiore . |
| 4,446,848 | 5/1984 | Becker et al. . |
| 4,462,542 | 7/1984 | Person . |
| 4,473,061 | 9/1984 | Milano . |

*Primary Examiner*—Henry Bennett
*Assistant Examiner*—Derek S. Boles
*Attorney, Agent, or Firm*—Gifford, Krass, Groh, Sprinkle, Anderson & Citkowski, P.C.

[57] ABSTRACT

A heat transfer system for use with a conventional fireplace for radiating heat at a remote location from the fireplace. The heat transfer system includes a network of interconnecting conduit sections charged with an internal fluid medium and consists of a plurality of coils located within the fireplace so that the fluid medium is subjected to heat generated within the fireplace. The conduit network further includes a radiant convection device for convecting the heat generated within the fluid medium to the surrounding area and an expansion tank located on a cool side of the convection device for storing a volume of the medium for subsequent redelivery to the fireplace coils. A series of first, second and third valves are located along the conduit network and separate the fireplace coils and radiant convection device, the convection device and the expansion tank, and the expansion tank and the fireplace coils, respectively. A steam inversion tube is also arrayed in communicating fashion between the inlet and outlet of the fireplace coils and functions in a first step to entrap superheated steam generated within the coils by the fluid medium and in a second step to both pre-heat return cool water from the expansion tank and to saturate the steam back to the fluid medium.

15 Claims, 7 Drawing Sheets

FIREPLACE HEAT TRANSFER SYSTEM WITH INTERNALLY DRIVEN FLUID FLOW MECHANISM

BACKGROUND OF THE INVENTION

1. Field of the Invention

The present invention relates generally to fireplace or wood stove generated conduit heating systems and, more particularly, to a substantially enclosed fireplace heat transfer system with internally driven heat transfer flow and return fluid flow mechanisms.

2. Description of the Prior Art

Fireplace based conduit heating systems are well documented in the art, of which are included both the water flow and air flow heating systems for the specific purpose of transferring heat generated within the fireplace to a remote location for radiant convection of a surrounding area. The purpose behind such systems generally is to recycle a significant portion of the heat which is otherwise wasted through the fireplace vent or chimney.

U.S. Pat. No. 4,153,199, issued to Ellmer, discloses a fireplace heating system capable of being installed in a conventional fireplace and including a log supporting water conduit grate. The water in the grate is heated by the logs and is then pumped to a suitable heat exchanger disposed within an air duct of a forced air heating system to heat the air passing therethrough. Heated water may also bypass the heat exchanger and is used to preheat a cold water supply that feeds a hot water heater.

A further example of such a heating system is disclosed in U.S. Pat. No. 4,462,542, issued to Person, which teaches an auxiliary heating system which also utilizes conduit for transferring heated air or water from an auxiliary heater, again either a fireplace or wood burning stove, and by means of a pump which provides the heated fluid to a forced air system, hydronic boiler system or hot water heater. A similar example of a pump-driven fireplace heating system is also disclosed in U.S. Pat. No. 4,025,043, issued to Cleer, Jr. in which heated water within a fireplace jacket is pumped to a separate water heater and/or radiant heater.

Finally, an additional example of a home heating system is disclosed in U.S. Pat. No. 4,330,083, issued to Di Fiore, which teaches a home heating system in which the heated water is supplied to a water heater or clothes dryer. An arrangement of control valves are utilized for to supply heat energy selectively or concurrently to home appliances in a desired combination. At least one expansion tank is located on the heated water outlets from the fireplace and a boiler to accommodate expansion and contraction of the volume of water in the heating system.

SUMMARY OF THE PRESENT INVENTION

The present invention is a fireplace heat transfer system employing an internally driving fluid flow mechanism for supplying both heated water for radiation through a baseboard or under floor radiant system and for returning the cold water outlet to the fireplace located conduit for subsequent reheating. The heat transfer system includes a network of interconnecting conduit sections charged with an internal fluid medium, in the preferred embodiment that being a quantity of water. A first conduit section is provided by a plurality of coils which are arranged proximate to the fireplace and, in a preferred embodiment, are integrally formed with a cradle of fireplace for holding the logs.

A first valve is located at an outlet of the fireplace coils and actuates from a closed position to an open position in response to a first selected fluid pressure being achieved within the heated fluid medium. A steam inversion tube is located in fluid communication with the outlet of the fireplace coils and an inlet of the first valve and includes an outer coaxial chamber and an inner coaxial chamber capable of entrapping superheated stem generated by the heated fluid medium.

A further length of conduit section connects a radiant convection device arrayed at a remote location with the outlet of the first valve on a "hot" side and receives therethrough a flow of the heated fluid medium so as to convect heat therefrom to a surrounding environment. The radiant convection device according to the preferred embodiments is in the form of either baseboard or under floor radiant systems with an appropriate heated medium temperature of either 180 degrees or 120 degrees, respectively.

A second valve is spaced from the radiant convection device on a "cool" side of the convection device by a further length of conduit and, similarly to the first valve, opens in response to flow of the internal fluid at substantially the first selected fluid pressure. An expansion tank is located in fluid communication with an outlet of the second valve and begins to fill with the fluid medium in response to the flow of the fluid through the second valve. The expansion tank in the preferred embodiment includes an elastic and resilient bladder separating an interior of the tank into an upper volume and a lower volume, the upper volume communication with an inlet from the conduit network.

Upon a selected higher fluid pressure being established within the expansion tank, the second valve is closed and a third valve located on an outlet side of the tank is forced open so that the cooled fluid medium passes therethrough. The steam inversion tube previously described is connected to an outlet of the third valve and functions to both pre-heat the cooled water prior to delivering it to an inlet of the fireplace coils as well as saturating the superheated steam contained within the inner coaxial chamber of the inversion tube. Upon completion of the cycle, the valves are all closed and the fireplace begins to reheat the specified volume of internally charged fluid medium held within the coils for a subsequent cycle.

Additional features of the present invention include the provision of a bleed valve, relief valve and pressure/temperature gauge located on the "hot" side connection between the first valve and the radiant convection device. A make-up water unit is also located between the second valve and the expansion tank and enables additional volumes of water to be recharged into the enclosed system in the rare instances that such is required. Further, the first and second valves are preferably gravity fed valves which open and close in response to water pressure disparities on the inlet and outlet sides thereof.

BRIEF DESCRIPTION OF THE DRAWINGS

Reference will now be made to the attached drawings, when read in combination with the following specification, wherein like reference numerals refer to like parts throughout the several views, and in which.

DESCRIPTION OF THE PREFERRED EMBODIMENTS

Figure 1:
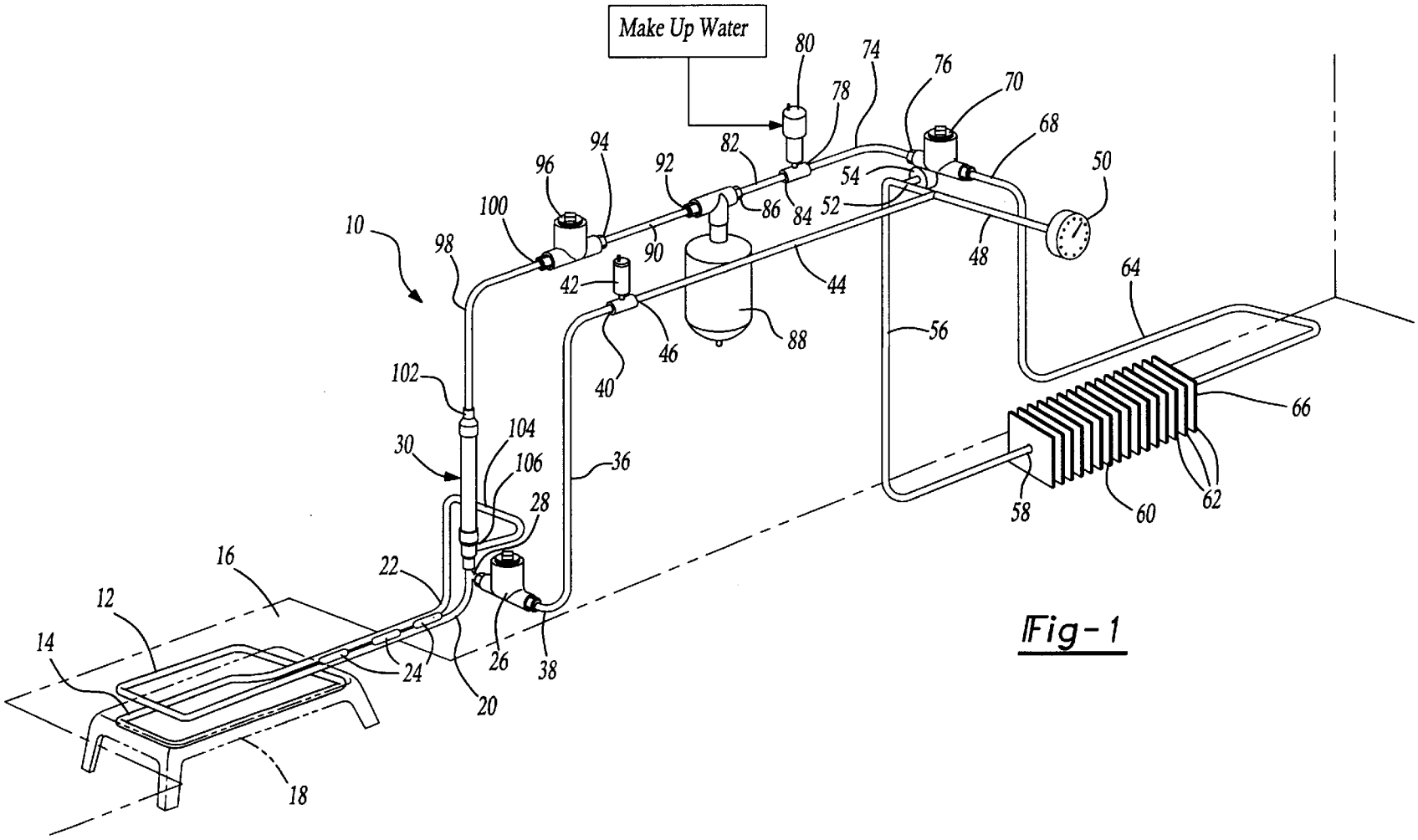
FIG. 1 is a perspective view illustrating the overall network of conduit sections forming the heat transfer system according to the present invention.

With reference to FIG. 1, the heat transfer system for use with a conventional fireplace is shown at 10 according to the preferred embodiment of the present invention. The heat transfer system is for use with a conventional fireplace or gas-fired fireplace (not shown) for radiating heat generated within the fireplace at a remote location, such heat otherwise typically being wasted through the chimney vent.

The heat transfer system 10 includes a plurality of coils of conduit, illustrated at 12 and 14, which are interconnected and wound consecutively. The coils 12 and 14 are located within a fireplace opening 16 and are arrayed in proximity to a plurality of logs (not shown) which are burned within the fireplace to generate heat. In a preferred embodiment, the coils are formed integrally with a cradle support base (see phantom illustration 18 in FIG. 1) and so as to maximize the degree of heat transfer within the system. An outlet is provided at 20 to the first coil 12 and an inlet at 22 to the second interconnected coil 14. The outlet 20 and inlet 22 extend in proximate and parallel fashion along a predetermined length and are joined together by copper braze welds 24, the purpose of which as will be subsequently described is to provide a measure of additional preheating to inlet water entering the coils 12 and 14 through inlet line 22.

The fireplace coils 12 and 14 comprise a portion of an overall interconnected network of conduit sections, all of which are preferably constructed of internally hollowed copper tubing and charged with an internal fluid medium such as water. A first valve 26 is in fluid communication with the outlet 22 of the fireplace coils 12 and 14, with an inlet of the first valve 26 branching off the coil outlet 22 at 28.

Figure 2:
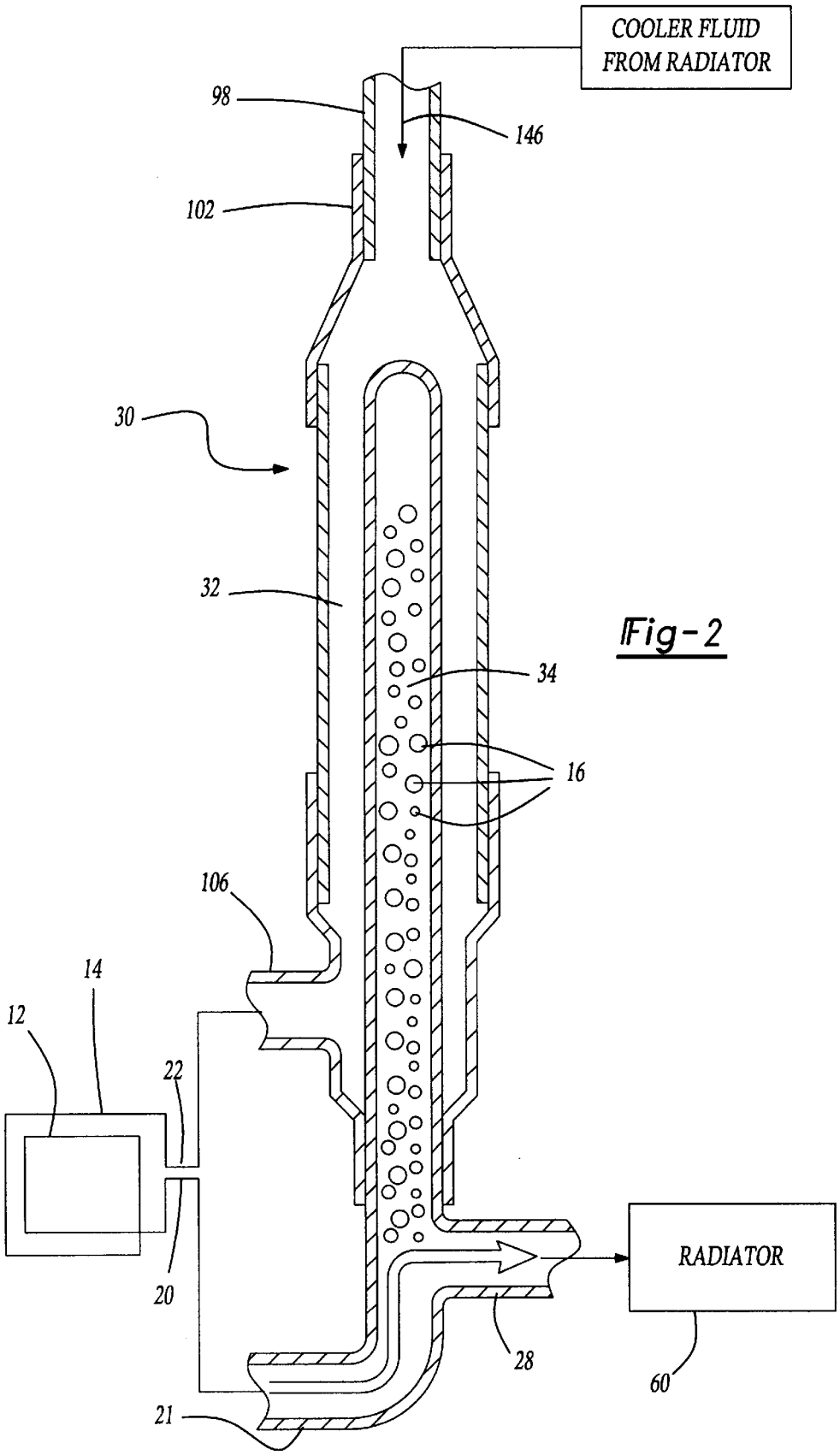
FIG. 2 is an enlarged sectional view in cutaway of the steam inversion tube according to the present invention.

Referring again to FIG. 1, and also to FIG. 2, a steam inversion tube 30 is arrayed in fluid communication with the outlet 20 of the fireplace coils 12 and 14 at 21 and an inlet of the first valve 26 defined by the branch 28. As is further illustrated in the sectional cutaway of FIG. 2, the steam inversion tube 30 includes an elongate and internally hollowed body which defines an outer coaxial chamber 32 and an inner coaxial chamber 34. The fireplace coils 12 and 14, inlet 20, outlet 22, and branch 28 extending to the first valve 26 inlet are all indicated schematically in FIG. 2. Reference will again be made to FIG. 2 in the subsequent description of the operation of the steam inversion tube 30 according to the heat transfer system of the present invention.

Referring again to FIG. 1, a further length of conduit section is illustrated at 36 and extends from an outlet 38 of the first valve 26 to an inlet 40 of a bleeder valve 42. A further section of conduit 44 extends from an outlet 46 of the bleeder valve 42 to a first branch 48 terminating in a temperature and pressure gauge 50 as well as a second and interconnecting branch 52 from which extends a relief valve 54. The second branch 52 continues on as a further interconnecting branch 56 which extends to an inlet 58 of a radiant convection device 60. The radiant convection device 60 is illustrated by a number of spaced apart and heat-convecting fins 62, however may actually be provided as either a baseboard or under the floor radiant heater, the construction of either being well known in the art.

A further conduit section 64 extends from an outlet 66 of the radiant convection device 60 and terminates at an inlet 68 of a second valve 70. A further conduit section 74 extends from an outlet 76 of the second valve 70 and terminates at an inlet 78 of a make-up water unit 80. A further conduit section 82 extends from an outlet 84 of the make-up water unit 80 to an inlet 86 of an expansion tank 88. A further conduit section 90 extends from an outlet 92 of the expansion tank 88 to an inlet 94 of a third valve 96. A further and interconnecting conduit section 98 extends from an outlet 100 of the third valve 96 and terminates at an inlet 102 of the steam inversion tube 30. A final interconnecting conduit piece is illustrated at 104 and extends from an outlet 106 of the steam inversion tube which is in fluid communication with the inlet 22 of the fireplace coils 12 and 14.

Figure 3:
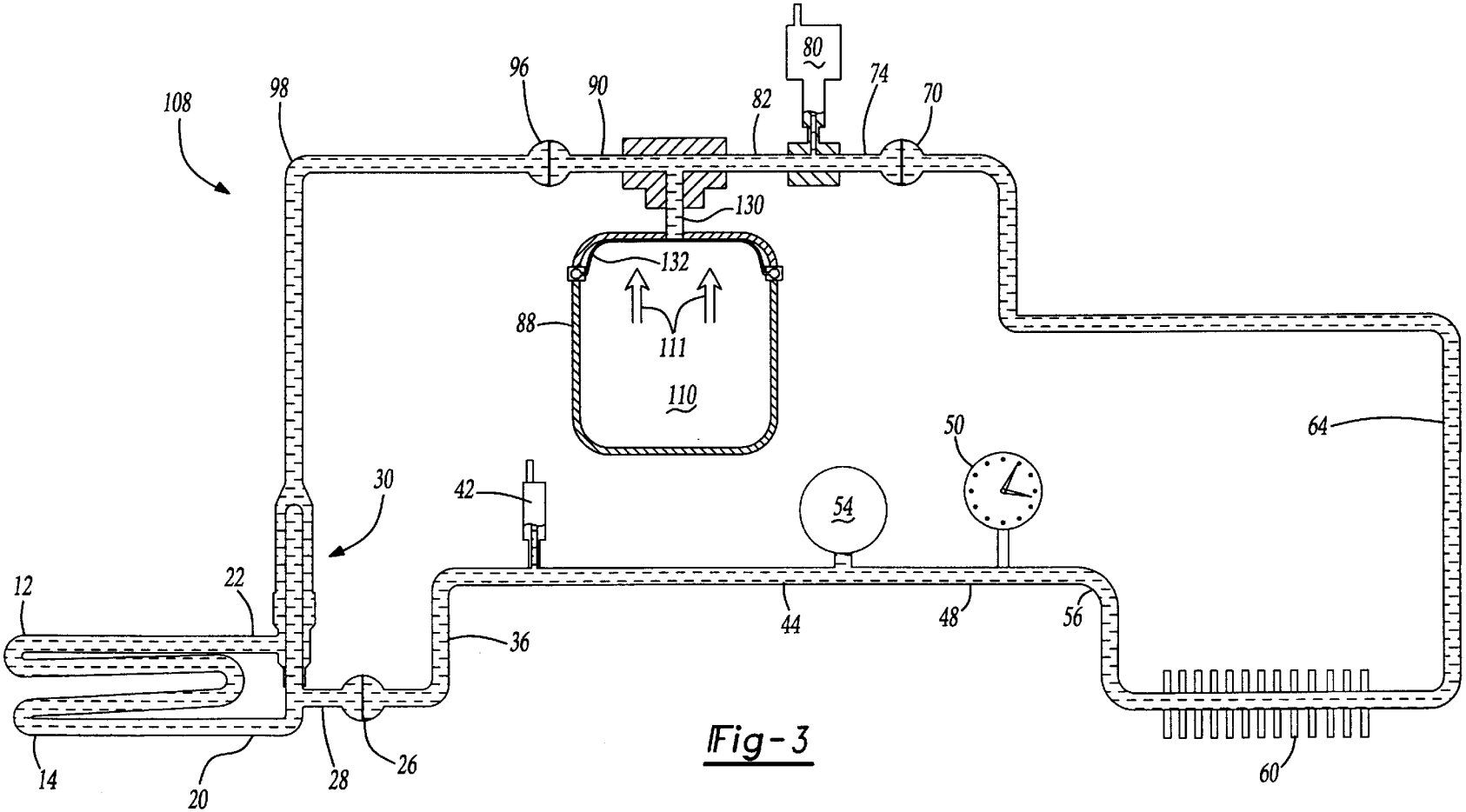
FIG. 3 is a schematic view similar to FIG. 1 and illustrating a first stage of the heat transfer system according to the present invention.

With reference now to FIGS. 3, 4, 5, 6 and 7, in combination with the illustrations of FIGS. 1 and 2, an explanation will now be made of first, second, third, fourth and fifth stages of the heat transfer system according to the present invention. With reference first to FIG. 3, a first stage is illustrated schematically at 108 and includes the fireplace coils 12 and 14, as well as all of the afore-described conduit sections 36, 44, 48, 52, 56, 64, 74, 82, 90, 98 and 104 (see also FIG. 1) being charged with the internal fluid medium, again such being typically a volume of water. In this state, the first valve 26, second valve 70 and third valve 96 are all in a closed position and an interior 110 of the expansion tank 88 (illustrated in cutaway) is completely empty of any fluid and exerts an interior pressure of preferably 8 pounds per square inch (psi).

Figure 4:
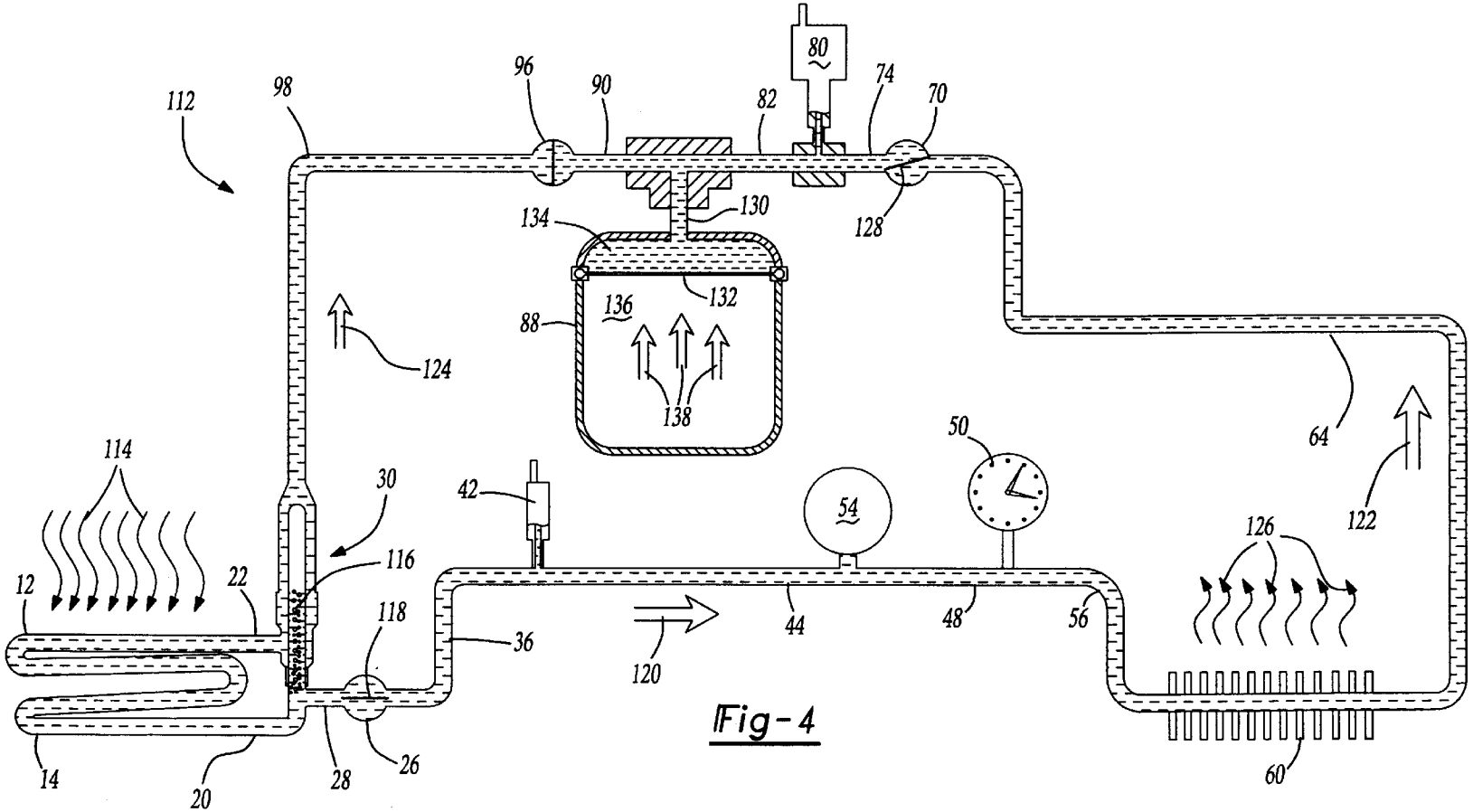
FIG. 4 is a view similar to FIG. 3 and illustrating a second stage of the heat transfer system according to the present invention.

With reference now to FIG. 4, a second stage is illustrated schematically at 112 and it is here that the fireplace coils 12 and 14 are heated by convecting waves 114 emanating from the fireplace. The convecting waves 114 cause the temperature of the fluid medium/water within the coils 12 and 14 to elevate to a selected overall temperature (120 degrees Fahrenheit for use with an under floor radiant heater and 180 degrees Fahrenheit for use with a baseboard heater). Subsequent heating of the fireplace coils 12 and 14 causes some of the water to convert to superheated steam, which is indicated by bubbles 116 and is entrapped within the inner coaxial chamber 34 of the steam inversion tube 30.

The effect of heating of the fireplace coils 12 and 14 causes the first valve 26 to actuate to the open position (as indicated by valve member 118) and to permit the heated fluid medium to flow along the conduit sections 36, 44, 48, 52, 56, and 64 as is generally indicated by directional arrows 120 and 122. At the same time, a back pressure is generated along the conduit section 98 by the heated fluid medium in the fireplace coils 12 and 14 and which maintains the third valve 96 in the closed position. As is further known in the art, the first and second valves 26 and 70 are gravity valves and the third valve 96 may also be a gravity fed valve as well as a spring or other pressure loaded valve.

In the preferred embodiment, the first valve 26 is actuated to the open position upon an inlet pressure substantially around 8 pounds per square inch (psi) being established by the heated medium within the fireplace coils 12 and 14. The back pressure 124 along conduit section 98 is also in the range of 8 to 12 psi at this stage and acts to maintain the third valve in the closed position due to a higher pressure existing on its outlet side.

The bleeder valve 42 serves to bleed out of the system any air existing within the heated fluid medium after the superheated steam 116 is entrapped within the steam inverter 30 and the first valve 26 has been opened. The relief valve 54 is preferably set at 30 psi and, in the event of an occurrence of a failure in the system, to permit the internal pressurized fluid to be vented from the system prior to damaging any of its components. The temperature/pressure gauge 50 is again of any construction known in the art and functions to notify the operator of the temperature and pressure existing within the system.

Referring again to FIG. 4, heated fluid traveling through the interconnecting conduit sections and along directional arrow 120 passes through the radiant convection device 60 and so that the heat within the fluid is capable of being convected to the surrounding area (such as a residential or commercial interior of a home) as illustrated by directional heat arrows 126. After passing through the radiant convection device 60 and entering the interconnecting conduit section 64, the fluid medium is considered as being on the "cold" side of the heat transfer system (as opposed to the "hot" side which would exist from the flame coils 12 and 14 and up to the conduit section 56).

The internally charged fluid traveling along directional arrow 122 and within interconnecting conduit section 64 is still established at approximately 8 psi according to the preferred embodiment and causes the second valve 70 to actuate to the open position (as illustrated by valve member 128) and so that the fluid enters an inlet 130 of the expansion tank 88 and begins to fill the open interior 110 of the tank 88. An elastic and resilient bladder 132 separates the interior 110 of the tank into an upper volume which is being filled with the fluid medium at 134 and a lower volume 136 across and against which the bladder 132 is outwardly biased. A series of directional arrows are shown 138 within the lower volume 136 of the tank 88 and exert a return pressure on the bladder 132. In the stage illustrated in FIG. 4, the degree of return pressure along arrows 138 is around 10 psi according to the preferred embodiment. The overall time duration of the second stage illustrated in FIG. 4 is calculated in the preferred embodiment to last approximately 5 to 15 seconds and precedes the third stage as will now be described in reference to FIG. 5.

Figure 5:
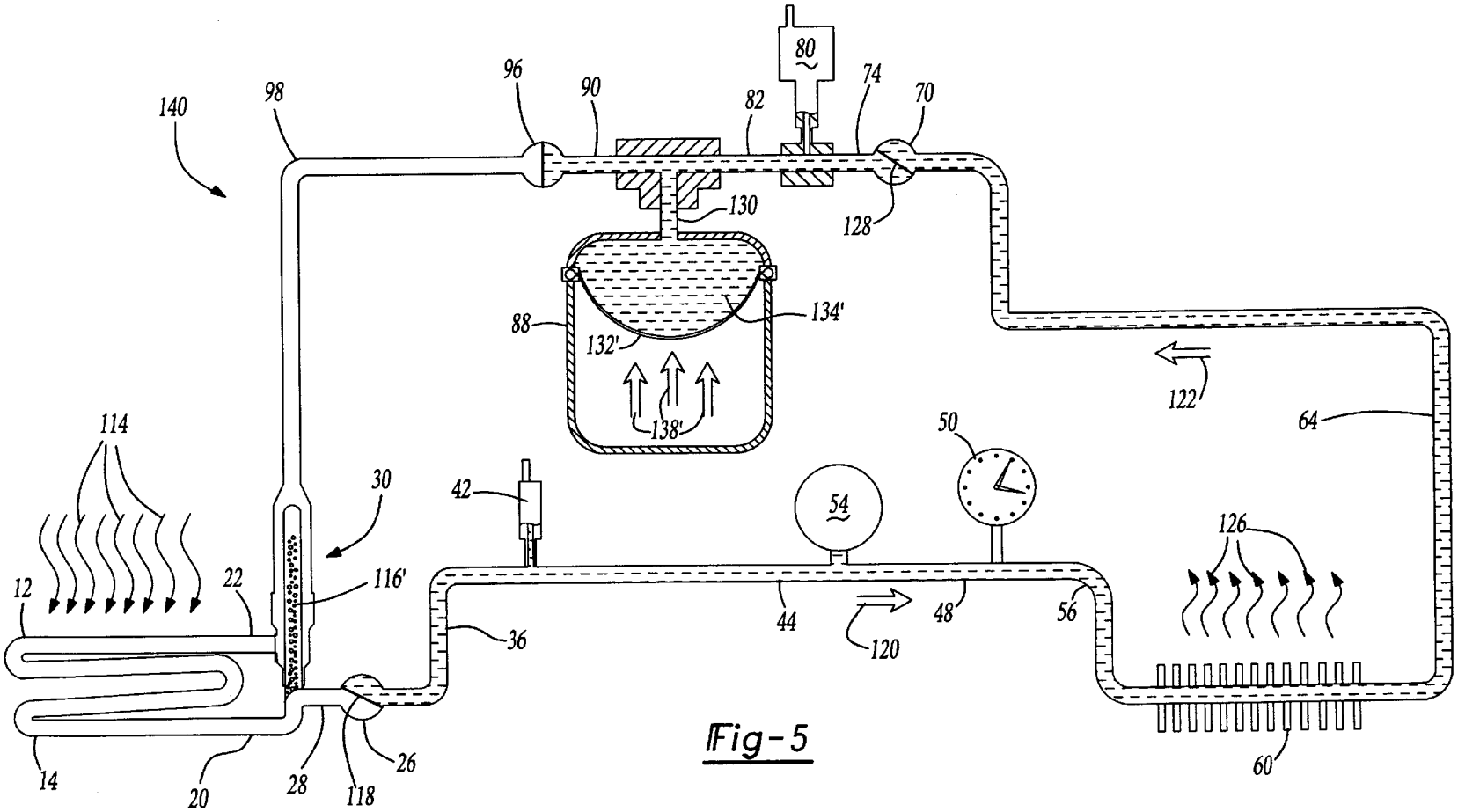
FIG. 5 is a like schematic view and illustrating a third stage of the heat transfer system according to the present invention.

Referring to FIG. 5, the third stage is illustrated schematically at 140 and, according to the preferred embodiment, continues for an additional time duration of between 40 and 50 seconds. At this stage, the heat from the fire is still being convected along lines 114 and substantially all of the fluid contained within the fireplace coils 12 and 14 and along the conduit sections interconnecting the first valve 26 and third valve 96 is in the process of being evacuated across the outlet of the first valve 26 and the valve member 118 is actuating to a closed position. The resultant closing of the first valve 26 creates a vacuum in the coils 12 and 14, the inlet side of the first valve 26, the outer coaxial chamber 32 of the steam inversion tube (see again FIG. 2) and the interconnecting conduit section 98 leading to the outlet of the third valve 96. Also, the level of steam entrapped within the inner coaxial chamber 34 is at a maximum amount at this stage as illustrated at 116'.

Flow of the internally charged fluid along the "hot" side (conduit sections 36, 44, 52 and 56), through the radiant convection device 60, and along the "cold" side (conduit section 64) continues prior to closing of the first valve 26 and the almost simultaneous closing of the second valve 70 illustrated by the position of the valve member 128. The closing of the second valve 70 is caused by the increasing pressure within the expansion tank 88 which is due to the further outward expansion of the resilient bladder to position 132', in turn resulting from the increase in volume of the fluid filling the upper volume of the tank 88 (as shown at 134'). At this point, the force being exerted by the lower volume of the tank is preferably at 12 psi (as illustrated at 138') and which overcomes the fluid pressure existing on the inlet side of the second valve 70 to close the second valve. The inlet pressure on the second valve 70 is measured at this point to be between 8 and 10 psi.

Figure 6:
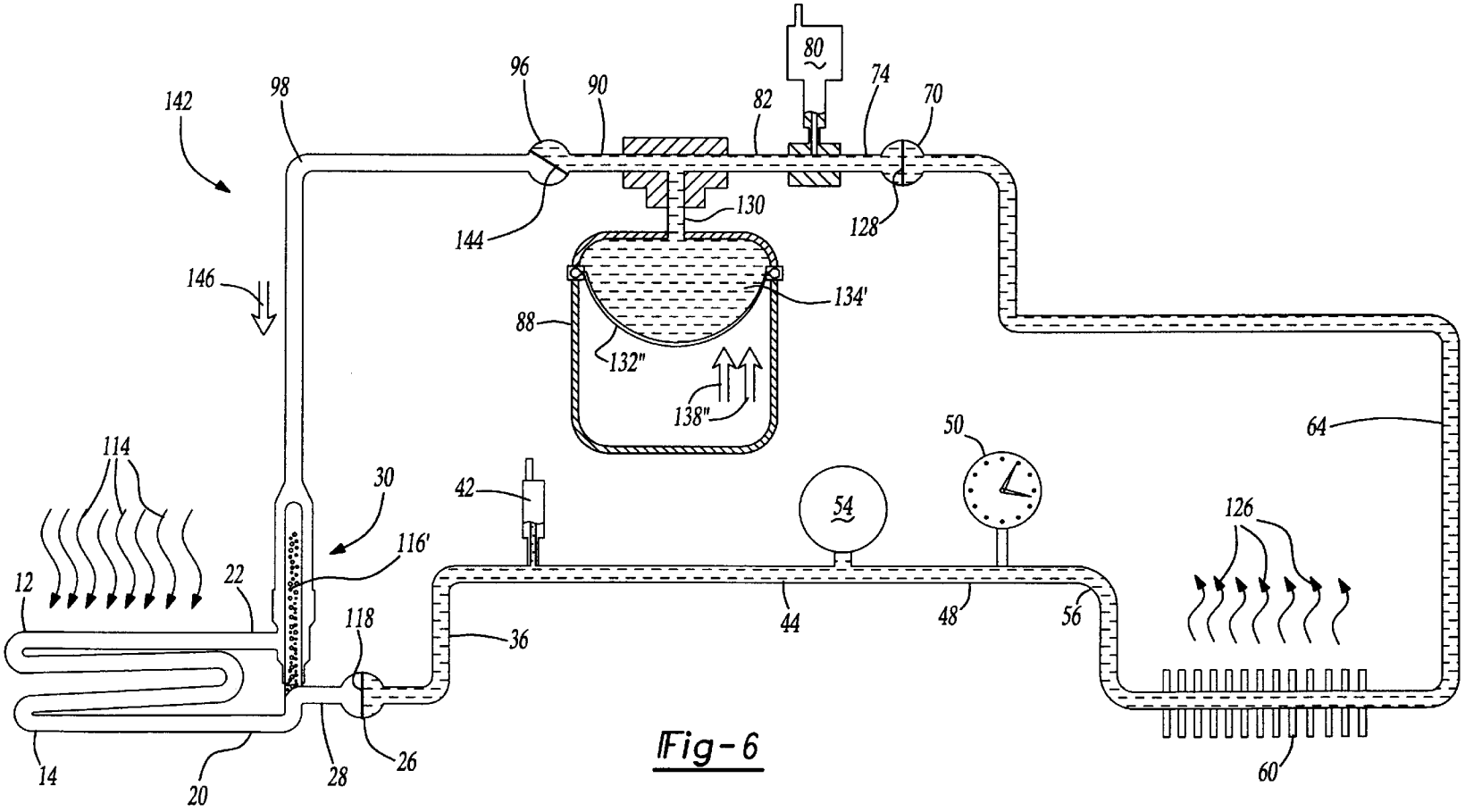
FIG. 6 is a like schematic view and illustrating a fourth stage of the heat transfer system according to the present invention.

Referring now to FIG. 6, a fourth stage is illustrated at 142 of the heat transfer system according to the present invention. At this stage, the valve member 118 of the first valve 26 is in the completely closed position, and the fluid is being held in a static manner within the fluid conduit sections 36, 44, 48, 52 and 56 on the "hot" side of the radiant convection device 60, within the convection device 60 itself, and on the "cold" side or conduit section 64. Even during this stage, the radiant convection device 60 is still giving off heat along directional arrows 126, although typically not at a level achieved in previous stages 2 and 3 as illustrated in FIGS. 4 and 5.

The resilient bladder within the expansion tank 88 is not at a completely filled position (as evidenced at 132") and the lower volume of the tank interior is exerting upwards of 15 psi against the bladder (as indicated by arrows 138"). At this point, the pressure exerted by the tank 88 through the inlet line 130 is well in excess of the pressure experienced by the second valve 70 on its inlet side. This causes the second valve 70 to completely close. Simultaneously, the third valve 96 is actuated to an open position as indicated by the position of valve member 144 and fluid contained within the upper volume of the tank interior (134") is permitted to begin to flow across the conduit section 98 located on the outlet side of the third valve 96 (see directional arrow 146).

Figure 7:
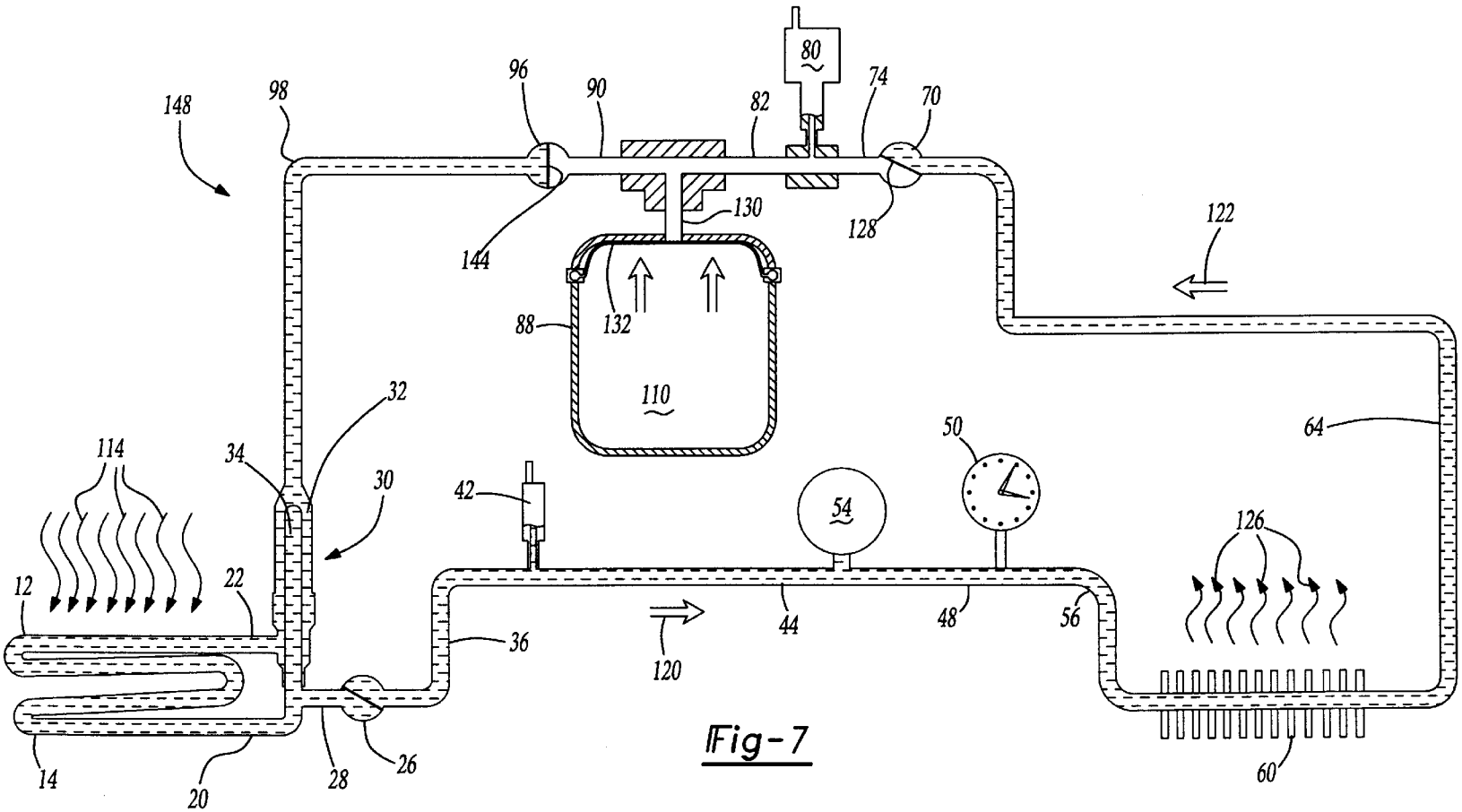
FIG. 7 is a like schematic view and illustrating a fifth and final stage of the heat transfer system according to the present invention.

Referring finally to FIG. 7, a fifth and final stage of the heat transfer system is illustrated at 148 and in which the interior 110 of the expansion tank 88 has been fully emptied of fluid and the third valve 92 has actuated to the closed position as evidenced by the position of valve member 144. Between stages 4 and 5 (FIGS. 6 and 7) the "cool" water traveling along conduit section 98 begins to pass through the outer coaxial chamber 32, the result of which is that it comes into convective contact with the steam 116' entrapped within the inner coaxial chamber 34. The effect at this point is two-fold: firstly, that the input water is now being pre-heated to some intermediate temperature between the cold side and the eventual temperature which it will obtain within the fire coils 12 and 14 and, secondly, the steam 116' within the inner coaxial chamber 34 is reciprocally saturated once again to fluid (as is also shown in the initial stage of FIG. 3). It is desirous to draw as much heat as possible out of the fluid both during and after it has been passed through the radiant convection device and a base temperature of 60 degrees Fahrenheit is realistically desired.

The fifth stage of FIG. 7 closely precedes a repeat cycle of the heat transfer system according to the present invention and progresses into a repeat of the second stage of FIG. 4. In the stage of FIG. 7, the fluid is again translating through the conduit sections 36, 44, 48, 52 and 56, across the radiant convection device 60, and along the subsequent conduit section 64 up to and just prior to reaching the inlet of the second valve 70.

Having described my invention, additional embodiments will become apparent to those skilled in the art to which it pertains. Specifically, the conventionally employed radiant convection device can include any one of a number of different mediums, such as a water heater, boiler or even hot tub or jacuzzi. Also, the input and output temperatures can be set at any different value as is desired for optimal performance of a given application. Reference will now be had to the appended claims in relation to the preferred embodiments previously discussed.

I claim:

1. A heat transfer system for use with a fire generating medium for radiating heat at a remote location from the fireplace, said heat transfer system including a network of interconnecting conduit sections charged with an internal fluid medium and comprising:

at least one coil of said conduit being located within the fire generating medium so that said fluid medium is subject to heat generated within the medium;

a first valve located at an outlet of said at least one coil and actuating from a closed position to an open position in response to a first selected fluid pressure being achieved within said heated fluid medium, a steam inversion tube in fluid communication with said outlet of said coil and an inlet of said first pressure actuated valve, said inversion tube including an outer coaxial chamber and an inner coaxial chamber which entraps superheated steam generated by said internal fluid medium within said coil;

a radiant convection device arrayed at a remote location and in fluid communication with an outlet of said first valve, said convection device receiving therethrough a flow of said heated fluid medium so as to convect heat therefrom to a surrounding environment;

a second valve located on an outlet side of said radiant convection device and actuating from a closed position to an open position in response to said flow of said internal fluid medium at substantially said first selected water pressure;

an expansion tank in fluid communication with an outlet of said second valve, said expansion tank beginning to fill with said internal fluid medium in response to said flow of said medium through said second valve;

a third pressure sensitive valve in communication with an outlet of said expansion tank and responsive on an inlet side to a second higher selected fluid pressure achieved within said expansion tank to actuate from a closed to an open position to permit said flow of fluid medium therethrough, said first and second valves actuating to said closed position prior to said opening of said third valve;

said steam inversion tube in fluid communication with an outlet of said third pressure sensitive valve and, responsive to passage of said fluid medium through said outer coaxial chamber, preheating said fluid medium concurrent with saturating said superheated steam; and said preheated fluid medium communicating with an inlet of said at least one fireplace coil and said third valve actuating to said closed position in response to a decrease in said outlet fluid pressure below said second selected fluid pressure.

2. The heat transfer system according to claim 1, further comprising a bleed valve located along said conduit network between said first valve and said radiant convection device, said bleed valve removing air remaining within said heated fluid medium.

3. The heat transfer system according to claim 2, further comprising a relief valve located along said conduit network between said bleed valve and said radiant convection device, said relief valve actuating from a closed position to an open position in response to said fluid medium achieving a third selected fluid pressure higher than said first and second fluid pressures.

4. The heat transfer system according to claim 3, further comprising a temperature and pressure gauge located along said conduit network between said bleed valve and said radiant convection device.

5. The heat transfer system according to claim 1, further comprising a make-up water unit located along said conduit network between said second pressure actuated valve and said expansion tank.

6. The heat transfer system according to claim 1, said radiant convection device further comprising a baseboard radiant heater.

7. The heat transfer system according to claim 1, said radiant convection device further comprising an under floor radiant heater.

8. The heat transfer system according to claim 1, said expansion tank further comprising an elastic and resilient bladder separating an interior of said tank into an upper volume and a lower volume, said upper volume in communication with an inlet of said tank from said conduit network, said bladder downwardly and outwardly actuating across said lower volume in response to filling of said tank with said internal fluid medium.

9. The heat transfer system according to claim 1, said internal fluid medium further comprising water, said first pressure sensitive valve actuating to said open position upon said first selected fluid pressure equaling 8 pounds of water pressure existing on said inlet side of said first valve.

10. The heat transfer system according to claim 1, said first valve closing upon said internal fluid medium being evacuated from within said fireplace coil.

11. The heat transfer system according to claim 9, said second valve opening upon 8 pounds of water pressure existing on said inlet side of said second valve, said second valve closing upon said expansion tank exerting a pressure on said outlet side of said second valve which is greater than said pressure on said inlet side.

12. The heat transfer system according to claim 11, said third valve opening upon said second higher selected fluid pressure equaling twelve pounds of water pressure existing on said inlet side of said third valve.

13. The heat transfer system according to claim 11, said closing of said first valve causing a vacuum to be created along said steam inversion tube and said coil, said opening of said third valve causing said vacuum to draw said fluid medium to refill said inversion tube and said coil.

14. The heat transfer system according to claim 1, the fire generating medium further comprising a fireplace, said at least one coil located within the fireplace further comprising a plurality of consecutively wound coils integrally formed with a cradle support base of the fireplace.

15. The heat transfer system according to claim 14, further comprising said inlet and outlet of said wound coils extending in proximate and parallel fashion over a selected length, a plurality of copper braze welds securing said inlet and outlet coils together and causing heating of said inlet coil by virtue of convection heat emanating from said steam inversion tube and through said outlet coil.

* * * * *